US006223559B1

(12) United States Patent
Coleman

(10) Patent No.: US 6,223,559 B1
(45) Date of Patent: May 1, 2001

(54) MEDICAL IDENTIFICATION CHARM BRACELET

(76) Inventor: Shelia J. Coleman, 3304 Caesar La., Donaldsonville, LA (US) 70346

( * ) Notice: Subject to any disclaimer, the term of this patent is extended or adjusted under 35 U.S.C. 154(b) by 0 days.

(21) Appl. No.: 09/357,627

(22) Filed: Jul. 20, 1999

(51) Int. Cl.[7] ..... A44G 13/00

(52) U.S. Cl. ..... 63/1.13; 40/633; 40/455; 40/457; 40/717

(58) Field of Search ..... 63/1.13, 3, 4; 40/717, 40/455, 457, 633

(56) References Cited

U.S. PATENT DOCUMENTS

| | | | | |
|---|---|---|---|---|
| 554,417 | * | 2/1896 | Forsheim | 63/4 |
| 2,138,596 | | 11/1938 | Fassnacht | 63/23 |
| 3,790,775 | | 2/1974 | Rosenblatt | 240/2.25 |
| 4,179,833 | | 12/1979 | Knodel | 40/21 C |
| 4,296,459 | | 10/1981 | DeLuca | 362/104 |
| 4,984,683 | | 1/1991 | Eller | 206/38 |
| 5,045,327 | * | 9/1991 | Tarlow et al. | 40/717 |
| 5,359,374 | * | 10/1994 | Schwartz | 40/717 |
| 5,755,116 | | 5/1998 | Sparacino et al. | 63/3 |
| 5,794,371 | * | 8/1998 | Camillery | 40/717 |

* cited by examiner

*Primary Examiner*—Cassandra H. Davis
(74) *Attorney, Agent, or Firm*—Hendrson & Sturm LLP

(57) ABSTRACT

A medical identification charm bracelet including a housing for housing an electronic circuit that includes an audible output device and a visual output device that is activatable to draw attention to the I.D. bracelet and the information inscribed on the various bracelet charm attachments to notify medical personnel of various medical conditions of the wearer.

1 Claim, 1 Drawing Sheet

MEDICAL IDENTIFICATION CHARM BRACELET

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to the field of jewelry, and more particularly to identification jewelry which provides medical information concerning the wearer.

2. Description of Related Art

As can be seen by reference to the following U.S. Pat. Nos. 2,138,596; 3,790,775; 4,179,833; 4,256,459; 4,296,459; 4,984,683; and 5,755,116, the prior art is replete with myriad and diverse identification bracelets.

While all of the aforementioned prior art constructions are more than adequate for the basic purpose and function for which they have been specifically designed, they are uniformly deficient with respect to their failure to provide a simple, efficient, and practical medical identification charm bracelet including audible and visual output devices.

As a consequence of the foregoing situation, there has existed a longstanding need for a new and improved medical identification charm bracelet and the provision of such a construction is a stated objective of the present invention.

BRIEF SUMMARY OF THE INVENTION

Briefly stated, the present invention provides a medical identification charm bracelet including a housing for housing an electronic circuit that includes an audible output device and a visual output device that is activatable to draw attention to the I.D. bracelet and the information inscribed on the various bracelet charm attachments to notify medical personnel of various medical conditions of the wearer.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
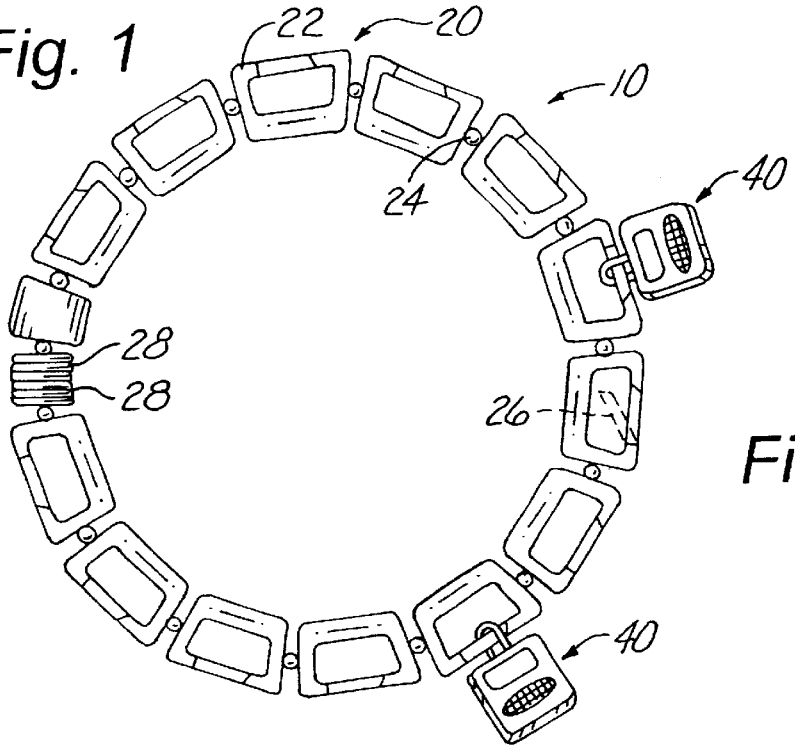
FIG. 1 is a perspective view of a charm bracelet of the present invention.
Figure 2:
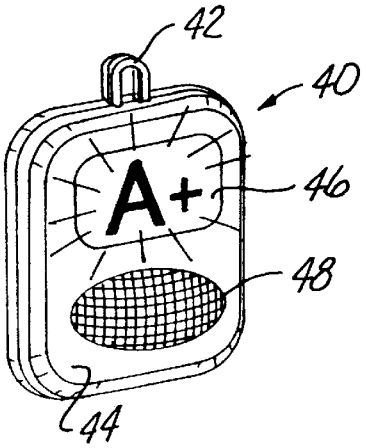
FIG. 2 is an enlarged front perspective view of a charm attachment.
Figure 3:
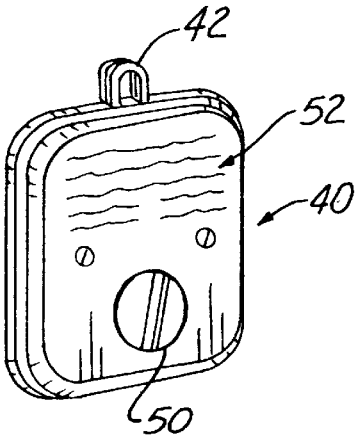
FIG. 3 is an enlarged rear perspective view of the charm attachment.
Figure 4:
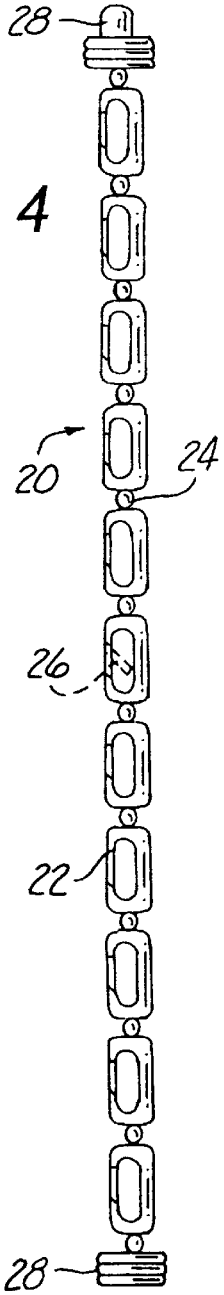
FIG. 4 is a top plan view of the bracelet band in the unconnected mode.

As can be seen by reference to the drawings, and in particularly to FIG. 1, the medical identification charm bracelet hat forms the basis of the present invention is designated generally by the reference number 10.

The bracelet 10 includes a bracelet band 20 with various charm attachments 40 engraved with medical information, emergency information, etc., so that in the event of a life threatening situation, medical personnel would be able to quickly determine any special precautions which must be observed in treating the patient.

The bracelet 10 is made of an attractive gold or silver design. Charm attachment 40 could include medical symbols and emergency contact information. Also, there could be a blood-drop shaped charm with the user's blood type. Additional charm attachments would be available to cover specific medical conditions.

The bracelet 10 includes a standard type bracelet band 20 consisting of charm rod hinges 22, bracelet hinges 24, carabiner style locks 26, and two clasps 28. The charm rod hinges 22 allow the user to open the rod hinges 22 anywhere on the bracelet band 20 to connect a charm 40, and allow the user to use the carabiner style locks 26 to keep the charms 40 from falling off the bracelet 10. The charms 40 attach by means of ring type clips 42. The front of the charm 40 is designed to contain a metal face 44 with a die cast panel 46 and a function button 48 that activates the highlighted visual display of the medical condition of the user by a light that shines through the die cast panel 46. Also, a brief audible message indicating the condition is activated by the function button 48. The back of the charm 40 houses a battery 50 that feeds power to the function button 48. Charms 40 are available to cover a multitude of medical conditions such as abnormal blood cells, allergic reactions, arthritis, asthma, high blood pressure or hypertension, cancer, clots, contact lens user, rod locket user, deafness or hearing loss, depression, diabetics, epilepsy, handicapped, heart disease, juvenile rheumatoid arthritis, leukemia, liver disease, lupus, mistral value disorders, pregnancy, pulmonary disorders, reading disabilities, sickle cell anemia, sleeping disorders, speech impairment, transplantation, thyroid problems, ulcers, etc. Any known medical conditions could be indicated by a charm attachment 40. Charms 40 alerting to allergic reactions would indicate what causes the reaction such as bee stings, blood transfusions, insect bites, certain foods; e.g., dairy products, nuts, tomatoes, seafood, etc., or medications; e.g., codeine, penicillin, etc. Blank charms 40 would be available allowing data concerning unusual medical requirements or conditions to be engraved as required, for example, as indicia 52 on the back of the charm 40. Charms 40 could be removed at any time if a medical condition or situation changes and is no longer a problem to the wearer. The bracelet 10 could be made in a variety of materials allowing models from economical to luxurious.

In use, the user would simply purchase the bracelet 10 with the charms 40 required to cover applicable blood type and any specific medical conditions or history that they may have. A photo of the user, and emergency contact information could also be placed inside the charm 40. They would then enjoy the benefit of having an attractive bracelet 10 which would allow any medical technician to quickly determine the patient's past and present medical history, so that they may take appropriate action or precaution during a time of need. Use of the bracelet 10 provides an attractive and easy to use method of allowing one to always have medical information on their person, which could very well help save their life if they are unconscious, or otherwise unable to provide this critical information in an emergency situation.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

What is claimed is:

1. A medical identification charm bracelet consisting of:

a bracelet band adapted to be worn on a wrist of an individual, the bracelet band including a plurality of segments;

a plurality of charm attachments each disposed to be selectively secured to one of the bracelet band segments, each charm attachment including:

a housing having a die cut panel including a visible display of a different specific medical condition of the individual;

an audible output device having a message related to the different specific medical condition of the individual;

a light disposed within the housing in visual communication with the indicia on the die cut panel; and a function button disposed on the housing and being electronically coupled to the visual output device wherein the audible output device is disposed within the housing and is electronically coupled to the function button.

* * * * *